US009555279B2

(12) United States Patent
Tong

(10) Patent No.: US 9,555,279 B2
(45) Date of Patent: Jan. 31, 2017

(54) ADJUSTABLE RESISTANCE EXERCISE APPARATUS

(71) Applicant: Kun Yuan Tong, Suwanee, GA (US)

(72) Inventor: Kun Yuan Tong, Suwanee, GA (US)

(73) Assignee: Kun Yuan Tong, Suwanee, GA (US)

( * ) Notice: Subject to any disclaimer, the term of this patent is extended or adjusted under 35 U.S.C. 154(b) by 29 days.

(21) Appl. No.: 14/120,785

(22) Filed: Jun. 27, 2014

(65) Prior Publication Data

US 2015/0375032 A1 Dec. 31, 2015

(51) Int. Cl.

| | |
|---|---|
| ***A63B 21/02*** | (2006.01) |
| ***A63B 21/055*** | (2006.01) |
| ***A63B 21/04*** | (2006.01) |
| ***A63B 21/00*** | (2006.01) |

(52) U.S. Cl.

CPC ..... *A63B 21/055* (2013.01); *A63B 21/00061* (2013.01); *A63B 21/00065* (2013.01); *A63B 21/0428* (2013.01); *A63B 21/4033* (2015.10); *A63B 21/4034* (2015.10); *A63B 21/4035* (2015.10)

(58) Field of Classification Search

CPC ... A63B 21/05; A63B 21/0043; A63B 21/023; A63B 21/025; A64B 21/026

See application file for complete search history.

(56) References Cited

U.S. PATENT DOCUMENTS 5,484,368 A * 1/1996 Chang ..... A63B 21/00043 482/122

* cited by examiner

*Primary Examiner* — Loan H Thanh
*Assistant Examiner* — Rae Fischer
(74) *Attorney, Agent, or Firm* — United States Research and Patent Firm; Guosheng Wang

(57) ABSTRACT

The adjustable variant resistance exercise apparatus has installed several different resistant elastic springs and can provide variety of resistance for exercise. Man, woman, boy and girl can share the same one of adjustable variant resistance exercise apparatus for exercise. User can upgrade or downgrade exercise resistant power by adding more or remove some elastic rubber bands for exercise.

9 Claims, 4 Drawing Sheets

14

ADJUSTABLE RESISTANCE EXERCISE APPARATUS

THE BACKGROUND OF THE INVENTION

Adults and teenagers have different muscular strength. Besides, after a long period of time of exercise everyone's muscular strength will get stronger and will need more powerful resistance exercise apparatus for exercise. Adjustable resistance exercise apparatus can provide variant resistance and can upgrade or downgrade the resistance power to suit individual's need for exercise.

THE BRIEF SUMMARY OF THE INVENTION

People exercise to grow their muscles and have to upgrade exercise apparatus for more powerful resistance. Adjustable resistance exercise apparatus can install several exchangeable variant resistance rubber bands for upgrading or downgrading resistance power. Therefore the user can upgrade the resistance power by adding more or more stronger resistance rubber bands. The user can also downgrade the resistance power by removing some resistance rubber bands or replacing the stronger resistance rubber bands with less powerful resistance rubber bands. All family members can share the same one of adjustable resistance exercise apparatus for exercise.

THE BRIEF DESCRIPTION OF DRAWINGS

DETAILED DESCRIPTION OF THE INVENTION

Figure 1:
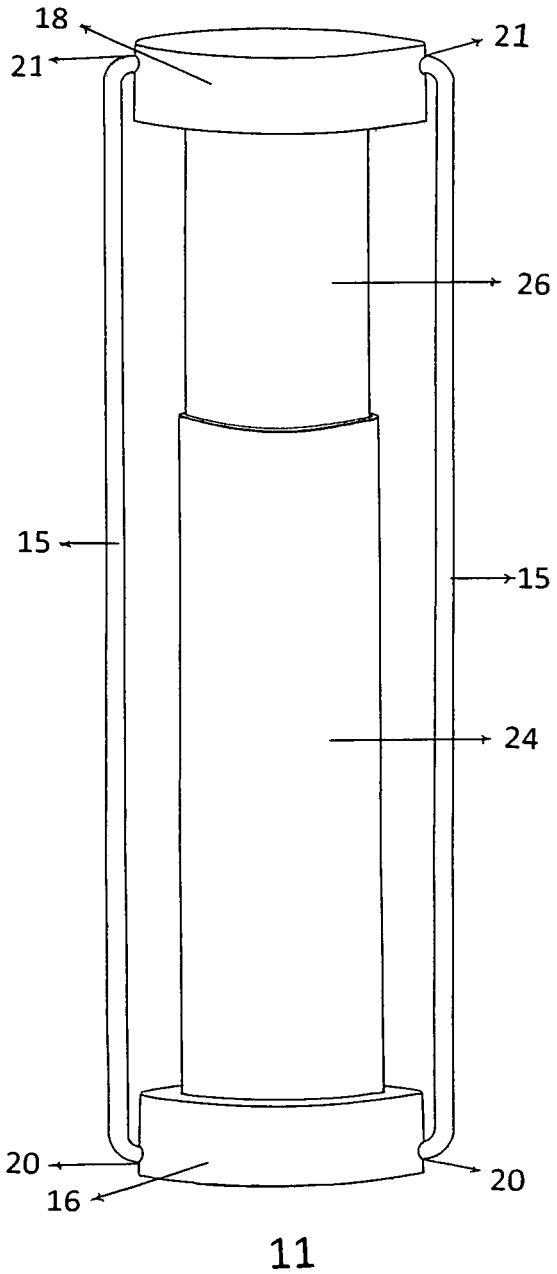
FIG. 1 is a perspective view of adjustable resistance exercise apparatus.
Figure 2:
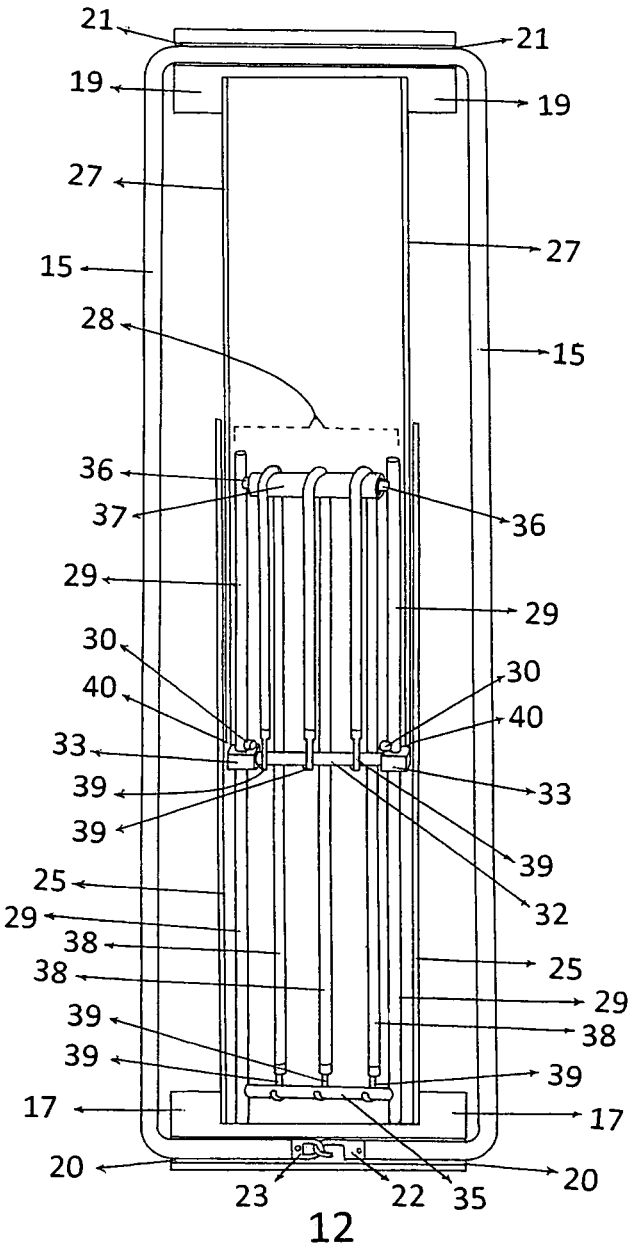
FIG. 2 is a perspective view of dissected tubular structure of adjustable resistance apparatus to reveal the inner intact key resistance apparatus.
Figure 3:
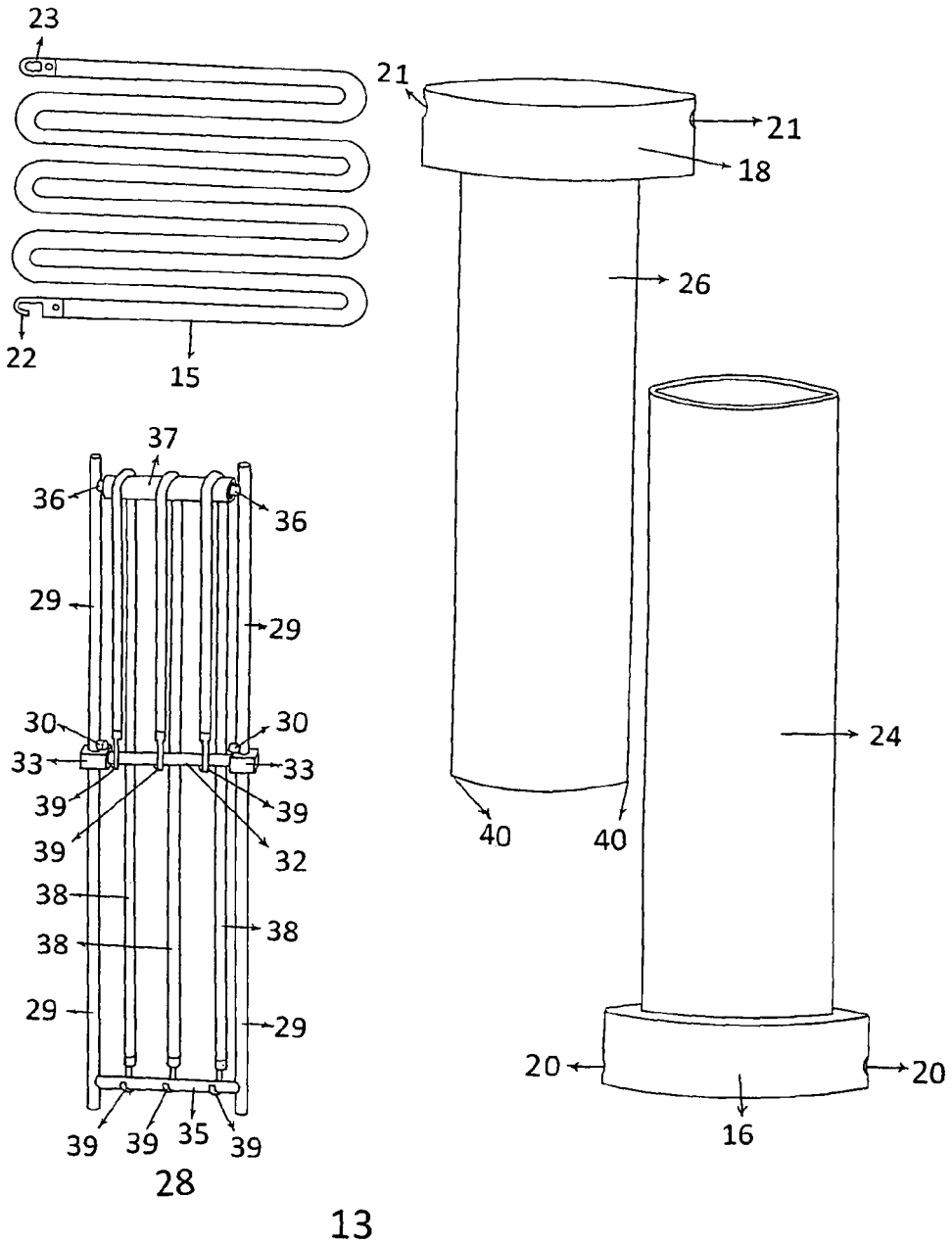
FIG. 3 is a perspective view of components of adjustable resistance exercise apparatus.
Figure 4:
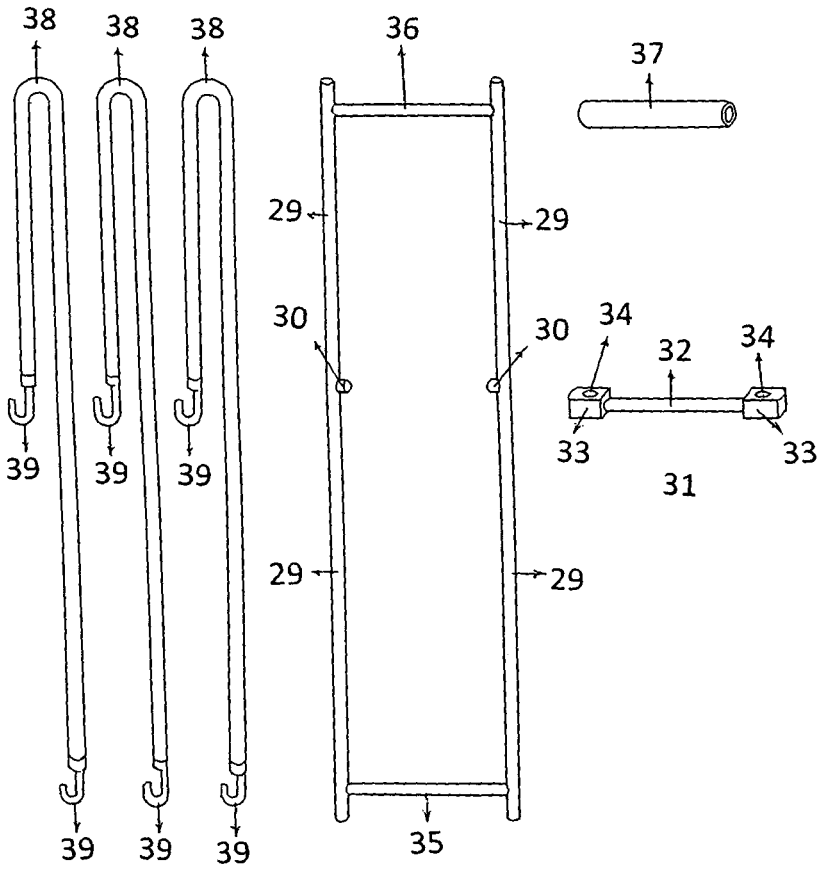
FIG. 4 is a perspective view of components of inner key resistance apparatus.

Referring now in detail to the drawings numeral 11 of FIG. 1 is adjustable resistance exercise apparatus. Numeral 12 of FIG. 2 is the dissected tubular structure of adjustable resistance exercise apparatus with the intact inner key resistance apparatus to reveal its position inside tubular structure. Numeral 13 of FIG. 3 is the components of adjustable resistance exercise apparatus. Numeral 14 of FIG. 4 is components of the inner key resistant apparatus. Numeral 15 of FIGS. 1, 2 and 3 is a rope. Numeral 16 of FIGS. 1 and 3 is lower cap. Numeral 17 of FIG. 2 is dissected lower cap 16. Numeral 18 of FIGS. 1 and 3 is top cap. Low cap 16 and top cap 18 are preferably identical. Numeral 19 of FIG. 2 is dissected top cap 18. Numeral 20 of FIGS. 1, 2 and 3 is tunnel of lower cap 16. Numeral 21 of FIGS. 1, 2 and 3 is tunnel of top cap 18. Tunnel 20 and tunnel 21 are identical. Rope 15 can pass easily through tunnels 20 and 21. Numeral 22 of FIGS. 2 and 3 is hook of rope 15. Numeral 23 of FIGS. 2 and 3 is ring of rope 15. Hook 22 can hook on ring 23. Hook 22 and ring 23 can easily pass through tunnels 20 and 21. After squeezing top cap 18 and lower cap 16 inwardly to relax rope 15 one can pull hook 22 and ring 23 of FIG. 2 out of tunnel 20. Numeral 24 of FIGS. 1 and 3 is outer tube. Numeral 25 of FIG. 2 is the dissected outer tube 24. Numeral 26 of FIGS. 1 and 3 is inner tube. Numeral 27 of FIG. 2 is the dissected inner tube 26. Outer tube 24 can admit easily and snugly inner tube 26. Inner tube 26 can telescope and slide easily inside outer tube 24. Outer tube 24 and inner tube 26 are preferable to have the same length and overlap each other for about one quarter to one third of their lengths. Numeral 28 of FIGS. 2 and 3 is the inner key resistance apparatus. Numeral 29 of FIGS. 2, 3 and 4 is long longitudinal side rod of inner key resistance apparatus 28. Numeral 30 of FIGS. 2, 3 and 4 is stopper. Stopper 30 is preferably installed at or near the middle portion of inner side of long longitudinal side rod 29. Numeral 31 of FIG. 4 is a sliding lever. Numeral 32 of FIGS. 2, 3 and 4 is lever arm. Numeral 33 of FIGS. 2, 3 and 4 is sliding ring. Sliding lever 31 of FIGS. 2, 3 and 4 has one sliding ring 33 installed at each end. Numeral 34 of FIG. 4 is central canal of sliding ring 33. Central canal 34 surrounds long longitudinal side rod 29 and slides easily on it. Stopper 30 of FIGS. 2, 3 and 4 can stop sliding ring 33 of sliding lever rod of FIGS. 2, 3 and 4. Numeral 35 of FIGS. 2, 3 and 4 is lower short horizontal rod. Numeral 36 of FIGS. 2, 3 and 4 is upper short horizontal rod. Upper short horizontal rod 36 and lower short horizontal rod 35 are identical and parallel. Sliding lever 31 is installed on two long longitudinal side rods 29 in between stopper 30 and lower short horizontal rod 35. Numeral 37 of FIGS. 2, 3 and 4 is roller. Roller 37 surrounds and rolls smoothly on upper rod 36. Numeral 38 of FIGS. 2, 3 and 4 is elastic rubber band. Elastic rubber band 38 can be of different elastic stretch power, such as 10 pounds or 15 pounds or 20 pounds etc. Numeral 39 of FIGS. 2, 3 and 4 is hook. There is one hook 39 installed at each end of each elastic rubber band 38. Hook 39 can hook on lower short horizontal rod 35 and lever arm 32. Numeral 40 of FIGS. 2 and 3 is brim of the inner tube 26. The way to install elastic rubber band 38 is to hook one hook 39 of one elastic rubber band 38 on lower short horizontal rod 35 and then to circle elastic rubber band 38 around roller 37 and then to hook another hook 39 of the same elastic rubber band 38 on lever arm 32 to produce slight tension of elastic rubber band 38. The more elastic rubber bands 38 are used the stronger the resistance power will be and the stronger elastic rubber band is used the stronger resistance power will be. The length of sliding lever 31 is longer than the outer diameter of inner tube 26 and shorter than the inner diameter of outer tube 24. The width of inner key resistance apparatus 28 from one outside rim of one long longitudinal side rod 29 to the other outside rim of another long longitudinal side rod 29 is a little bit shorter than the inner diameter of inner tube 26. Therefore the inner key resistance apparatus 28 can be inserted and stored snugly inside inner tube 26 and sliding ring 33 can rest on the brim 40 of inner tube 26. When top cap 18 and lower cap 16 are squeezed inwardly with two hands brim 40 of inner tube 26 will push sliding ring 33 of sliding lever 31 to stretch elastic rubber band 38 to produce exercise resistance to develop pectorals. When both sides of rope 15 are pulled outwardly with both hands brim 40 of inner tube 26 will also push sliding ring 33 of sliding lever 31 to stretch elastic rubber band 38 to produce exercise resistance to develop deltoids and back muscles. The user can use one foot or two feet to step on one side of rope 15 and use one hand or both hands to pull upward another side of rope 15 to develop biceps and quadriceps. By adding more or removing some elastic rubber band 38 the resistance power will increase or decrease. By replacing the weaker elastic rubber band 38 with stronger elastic band 38 the resistance power will increase and vice versa.

The invention claimed is:

1. An adjustable resistance exercise apparatus comprising one outer tube closed by a lower cap at one end, one inner tube closed by a top cap at one end, and one inner key resistance apparatus having exchangeable rubber bands, wherein the outer tube can admit easily and snugly inner tube, wherein the inner tube can telescope and slide easily inside the outer tube;

wherein the inner key resistance apparatus can be inserted and stored snugly inside inner tube; and when the top cap and the lower cap are squeezed inwardly, the inner tube will stretch the rubber bands to produce exercise resistance.

2. The adjustable resistance exercise apparatus of claim 1 further comprising a rope, wherein the lower cap has a tunnel, the top cap has a tunnel, and the rope can pass easily through the two tunnels.

3. The adjustable resistance exercise apparatus of claim 1, wherein said inner tube is of the same length as said outer tube, and can be inserted easily into said outer tube to overlap with it for about one quarter to one third of its length.

4. The adjustable resistance exercise apparatus of claim 2, wherein said rope is equipped with a hook at one end and a ring at the other end to hook each other together, and the rope can pass through said two tunnels to encircle said adjustable resistance exercise apparatus.

5. The adjustable resistance exercise apparatus of claim 1, wherein said inner key resistant apparatus comprises a rectangular frame with a stopper, a sliding lever, and a roller.

6. The adjustable resistance exercise apparatus of claim 5, wherein said rectangular frame with a stopper comprises two identical parallel long longitudinal side rods and each has a said stopper installed at or near the middle portion of its inner side to divide said rectangular frame into an upper frame and a lower frame and two identical parallel short horizontal rods which are assigned as an upper short horizontal rod installed near the upper end of said two identical parallel long longitudinal side rods to form a H-shaped figure at upper end and a lower short horizontal rod installed near the lower end of said two identical parallel long longitudinal side rods to form a H-shaped figure at lower end.

7. The adjustable resistance exercise apparatus of claim 6, wherein said sliding lever comprises a rod and two side sliding rings with a length shorter than the inner diameter of said outer tube and longer than the outer diameter of said inner tube.

8. The adjustable resistance exercise apparatus of claim 7, wherein said side sliding ring comprises a block which has a central canal to be installed at said lower frame and to slide freely on said long longitudinal rod but stopped by said stopper.

9. The adjustable resistance exercise apparatus of claim 8, wherein said roller comprises a round tube which encircles said upper short horizontal rod.

* * * * *